US009388522B2

(12) United States Patent
Yoon

(10) Patent No.: US 9,388,522 B2
(45) Date of Patent: Jul. 12, 2016

(54) SUSPENSION FOR WASHING MACHINE AND WASHING MACHINE WITH THE SAME

(71) Applicant: Dongbu Daewoo Electronics Corporation, Seoul (KR)

(72) Inventor: Hyoung Tae Yoon, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 267 days.

(21) Appl. No.: 14/098,482

(22) Filed: Dec. 5, 2013

(65) Prior Publication Data

US 2015/0128654 A1 May 14, 2015

(30) Foreign Application Priority Data

Nov. 11, 2013 (KR) ..... 10-2013-0136245

(51) Int. Cl.
*D06F 37/24* (2006.01)

(52) U.S. Cl.
CPC ..... *D06F 37/24* (2013.01)

(58) Field of Classification Search
CPC ..... D06F 37/20; D06F 37/24
See application file for complete search history.

(56) References Cited

U.S. PATENT DOCUMENTS 2,421,822 A * 6/1947 Wood ..... F16L 3/16 248/543
2,437,631 A * 3/1948 Wood ..... F16F 1/041 248/613
2,678,797 A * 5/1954 Roy ..... F16F 3/10 248/613
3,223,400 A * 12/1965 Deister, Jr. ..... F16F 3/10 248/613
4,025,011 A * 5/1977 Rapps ..... F16L 3/2053 248/561
5,657,649 A * 8/1997 Lim ..... D06F 37/24 248/613
5,946,946 A * 9/1999 Sharp ..... D06F 37/20 188/129
2004/0231372 A1* 11/2004 Kim ..... D06F 37/20 68/23.1
2004/0231373 A1* 11/2004 Kim ..... D06F 37/20 68/23.1
2004/0231374 A1* 11/2004 Chang ..... D06F 37/20 68/23.3

FOREIGN PATENT DOCUMENTS

KR 20000001693 A 1/2000
KR 1020000038933 A 7/2000

* cited by examiner

*Primary Examiner* — Joseph L Perrin

(57) ABSTRACT

A suspension for a washing machine and a washing machine with the suspension is disclosed. The suspension includes a support shaft; a first elastic member that surrounds a portion of the support shaft and provides a first elastic force to the support shaft in a longitudinal direction of the support shaft; a second elastic member between the support shaft and the first elastic member, and configured to provide a second elastic force different from the first elastic force to a support shaft in the same direction as the first elastic member; a guide stopper at one end of the support shaft, configured to restrict movement of the first elastic member and the second elastic member in one direction; and a housing on the support shaft that surrounds the first and second elastic members, configured to restrict movement of the first and second elastic members in another direction.

14 Claims, 3 Drawing Sheets

SUSPENSION FOR WASHING MACHINE AND WASHING MACHINE WITH THE SAME

CROSS-REFERENCE TO RELATED APPLICATIONS

This application is based on and claims priority from Korean Patent Application No. 10-2013-0136245, filed on Nov. 11, 2013, the disclosure of which is incorporated herein in its entirety by reference.

TECHNICAL FIELD

The present disclosure relates to a suspension for a washing machine and a washing machine with the suspension, and more particularly, to a suspension for a washing machine that achieves low vibrations and low noise, and a washing machine with the suspension.

BACKGROUND

In general, washing machines are designed to remove foreign substances absorbed in the laundry, while water supplied to the laundry is mixed and rotated or revolved.

There are various types of washing machines, including pulsator type washing machines that wash laundry using water streams generated by a pulsator in the tub. In the pulsator type washing machines, washing and spin-drying operations are performed in the water tank, and a suspension is disposed outside the water tank to prevent noise and movement of the tub due to excessive vibrations during the wash cycle or spin cycle.

However, depending on the amount of laundry placed in the water tank, the weight of the water tank may increase significantly due to the absorbed water the in laundry during the wash cycle. As a result, the difference in the entire weight depends on the amount of laundry in the tub and/or drum. Therefore, the entire weight of the water tank is proportional to the amount of laundry being washed.

Accordingly, vibrations, shock, and noise from the water tank during the wash cycle or the spin cycle may be absorbed and/or reduced by supporting the water tank at four points with a suspension. The suspension includes a compression spring that is designed in accordance with specifications that consider low-load conditions, but that is based on of the maximum load of the water tank.

However, when a small amount of laundry is washed, micro-vibrations may be generated due to the high elasticity of the compression spring. In contrast, when there is a relatively large amount of laundry, the water tank may become unbalanced and the suspension may fail to sufficiently absorb vibrations.

SUMMARY

The present disclosure has been made in an effort to provide a suspension for a washing machine that can sufficiently absorb vibrations, regardless of the amount of laundry.

The present disclosure has also been made in an effort to provide a washing machine that includes such a suspension.

Embodiments of the present disclosure provide a suspension for a washing machine including a support shaft; a first elastic member that surrounds a portion of the support shaft and provides a first elastic force to the support shaft in a longitudinal direction of the support shaft; a second elastic member that is between the support shaft and the first elastic member, and that provides a second elastic force different from the first elastic force to the support shaft in a same direction as the first elastic member; a guide stopper at a first end of the support shaft that restricts movement of the first and second elastic members in one direction; and an optional housing on the support shaft that surrounds the first and second elastic members, and restricts movement of the first and second elastic members in another (e.g., opposite) direction.

The first elastic member and the second elastic member may comprise compression coil springs, respectively.

The suspension for a washing machine may further include a support or support unit at another (e.g., opposite) end of the support shaft.

When pressure is applied longitudinally to the support shaft, the first elastic member may be compressed first and then the second elastic member may be compressed after application of a certain force (e.g., approaching a maximum compression of the first elastic member), and the second elastic member may be relatively more elastic than the first elastic member.

With regard to the maximum vibration pressure and/or compression that is applied to the first elastic member and the second elastic member, when the vibration pressure and/or compression is less than 40% of the maximum vibration pressure or compression of the first elastic member, the first elastic member alone may absorb the vibrations, and when the vibration pressure and/or compression is 40% or more of the maximum vibration pressure and/or compression of the first elastic member, both the first elastic member and the second elastic member may absorb the vibrations.

In the suspension for a washing machine, the housing may include a first locking portion configured to restrict movement of the first elastic member in the other direction and a second locking portion configured to restrict movement of the second elastic member in the other direction.

The uncompressed length of the second elastic member may be relatively small in compression to the maximum distance between the second locking portion of the housing and a guide stopper. Similarly, the second elastic member may have a length that is 25-50% of the length of the first elastic member.

Embodiments of the present disclosure provide a washing machine including a water tank configured to store water; a rotatable tub in the water tank configured to receive laundry; a cabinet that houses the water tank; and a suspension (e.g., one or more suspension units) for the washing machine that absorbs vibrations of the water tank, with a first end or side connected to the water tank and a second end or side connected to the cabinet. In one example, the suspension comprises four suspension units, each of which includes the support shaft, the first and second elastic members, the guide stopper, and the optional housing.

Additional embodiments of the suspension for a washing machine may include a support shaft; a first elastic member that surrounds a portion of the support shaft and provides an elastic force to the support shaft in a longitudinal direction of the support shaft; a second elastic member between the support shaft and the first elastic member and provides a different elastic force to the support shaft in a same direction as the first elastic member; a guide stopper at one end of the support shaft and that restricts movement of the first and second elastic members in one direction; and a housing on the support shaft that surrounds the first elastic member and the second elastic member and restricts movement of the first elastic member and the second elastic member in another (e.g., opposite) direction.

The first elastic member and the second elastic member may comprise compression coil springs, respectively.

The suspension for a washing machine may further include a support at the other end of the support shaft, and the support may be connected to the cabinet and the housing may be connected to the water tank.

When pressure is applied longitudinally to the support shaft, the first elastic member may be compressed first, and then the second elastic member may be compressed thereafter, and the second elastic member may be relatively more elastic than the first elastic member.

With regards to the maximum weight of the water tank, when the weight of the water tank is less than 40% of the maximum weight, the first elastic member may absorb the vibrations, and when the weight of the water tank is 40% or more of the maximum weight, both the first elastic member and the second elastic member may absorb the vibrations.

In the washing machine, the housing may have a first locking portion configured to restrict movement of the first elastic member in the other direction and a second locking portion configured to restrict movement of the second elastic member in the other direction.

The uncompressed length of the second elastic member may be relatively small in comparison to the maximum distance between the second locking portion of the housing and the guide stopper.

According to embodiments of the present disclosure, the suspension for a washing machine can stably and/or sufficiently absorb vibrations regardless of the amount of laundry.

According to embodiments of the present disclosure, the washing machine can effectively reduce vibrations, shock, and noise, even for different amounts of laundry, using the exemplary suspension.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
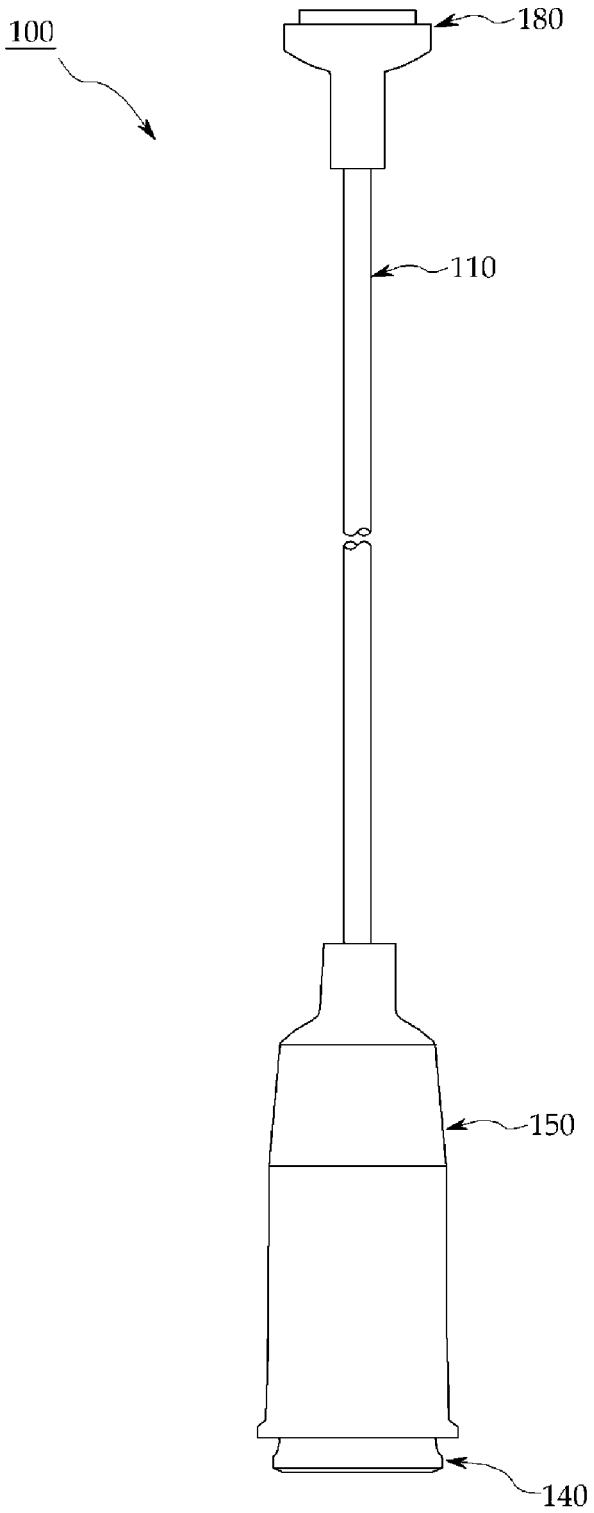
FIG. 1 is a front view of an exemplary suspension for a washing machine according to embodiments of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings for those skilled in the art to be able to easily carry out the present disclosure. The present disclosure may be implemented in various different ways and is not limited to the exemplary embodiment(s) described herein.

It should be noted that the drawings are schematically provided and not necessarily scaled. The relative dimensions and ratios of the parts illustrated in the drawings may be exaggerated or reduced in size for clarity and convenience in the drawings, and the dimensions are only examples without limitation. The same structures, components, or elements shown in two or more drawings are given the same reference numerals to show similar features.

Exemplary embodiments of the present disclosure show ideal examples of the present disclosure. Accordingly, the exemplary embodiments shown in the drawings are expected to be changed in various ways. Therefore, the exemplary embodiments are not limited to specific configurations in the drawings, and may be changed to have various shapes and/or arrangements by manufacturing.

A suspension 100 for a washing machine according to exemplary embodiments of the present disclosure will be described with reference to FIGS. 1 and 2.

Figure 2:
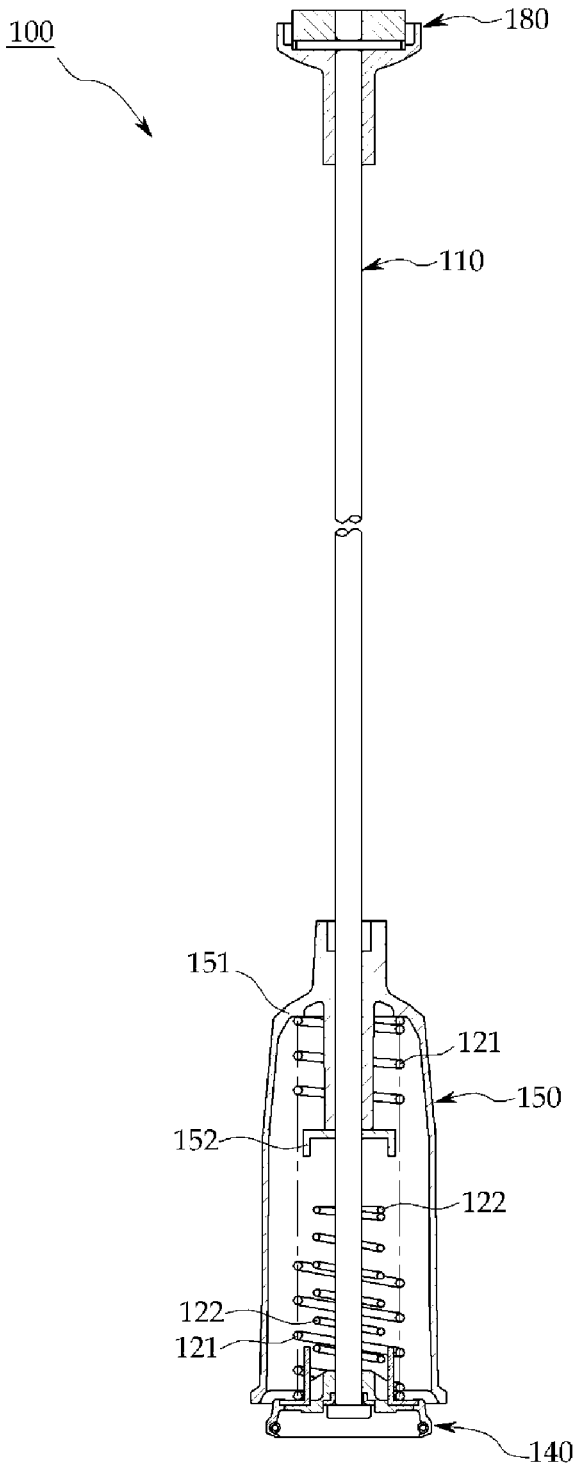
FIG. 2 is a cross-sectional view of the exemplary suspension for the washing machine illustrated in FIG. 1.

As illustrated in FIGS. 1 and 2, the suspension 100 for a washing machine according to exemplary embodiments of the present disclosure includes a support shaft 110, a first elastic member or spring 121, a second elastic member or spring 122, a guide stopper 140, and a housing 150.

The suspension 100 may further include a support 180.

The support shaft 110 may be in the shape of a bar, rod, dowel, or other cylindrical object with a much greater length than diameter. The suspension 100 absorbs vibrations that are applied in a longitudinal direction of the support shaft 110.

The first elastic member 121 surrounds a portion of the support shaft 110 and provides an elastic force to the support shaft 110 in the longitudinal direction of the support shaft 110.

The second elastic member 122 is between the support shaft 110 and the first elastic member 121. The second elastic member 122 provides an elastic force different from that of the first elastic member 121 to the support shaft 110 in the same direction as the first elastic member 121.

In embodiments of the present disclosure, the first elastic member 121 and the second elastic member 122 may comprise compression coil springs. The first and second elastic members may differ in compressibility, material(s), thickness of the wire in the coil, the spacing between loops in the coil, etc. However, embodiments of the present disclosure are not limited thereto, and the first elastic member 121 and the second elastic member 122 may be changed in various ways, as long as the elastic members provide a different elastic force in the longitudinal direction of the support shaft 110.

In exemplary embodiments of the present disclosure, when pressure is applied longitudinally to the support shaft 110, the first elastic member 121 may be compressed first and then the second elastic member 122 may be compressed thereafter. The second elastic member 122 may be relatively more elastic than the first elastic member 121.

The first elastic member 121 may be relatively longer than the second elastic member 122. In general, the first elastic member 121 may be at least two times longer than the second elastic member 122 (e.g., in a top loading washing machine). In some embodiments, the first elastic member 121 may be at least three times longer than the second elastic member 122 (e.g., in a front loading washing machine).

The guide stopper 140 is at one end of the support shaft 110. The guide stopper 140 restricts movement of the first elastic member 121 and the second elastic member 122 in one direction. As a result, the guide stopper 140 prevents the first elastic member 121 and the second elastic member 122 from separating from one end (e.g., the lower end) of the support shaft 110.

The guide stopper 140 may press against the first elastic member 121, and eventually the second elastic member 122, when pressure is applied to the support shaft 110.

The housing 150 is secured to the support shaft 110 and surrounds the first elastic member 121 and the second elastic member 122.

The housing 150 may include a first locking portion 151 configured to restrict movement of the first elastic member 121 in the other direction (e.g., in the direction of the support 180) and a second locking portion 152 configured to restrict movement of the second elastic member 122 in the other direction. As a result, the first locking portion 151 and the second locking portion 152 prevent the first elastic member 121 and the second elastic member 122 from separating in the other direction of the support shaft 110.

However, exemplary embodiments of the present disclosure are not limited thereto, and the housing 150 may restrict movement of the first elastic member 121 and the second elastic member 122 in the other direction with one locking portion.

Since the first elastic member 121 may be relatively longer than the second elastic member 122, the distance between the guide stopper 140 and the first locking portion 151 may also be longer than the distance between the guide stopper 140 and the second locking portion 152.

In exemplary embodiments of the present disclosure, the uncompressed length of the second elastic member 122 is relatively smaller than the maximum distance between the second locking portion 152 of the housing 150 and the guide stopper 140. As a result, when the first elastic member 121 is not compressed, the second elastic member 122 may be spaced apart from the second locking portion 152. When the distance between the guide stopper 140 and the second locking portion 152 decreases with compression of the first elastic member 121, the second elastic member 122 is also compressed between the second locking portion 152 and the guide stopper 140. Therefore, when pressure is applied longitudinally to the support member 110, the first elastic member 121 may be compressed and then the second elastic member 121 may be compressed.

In exemplary embodiments of the present disclosure, one of the housing 150 and the guide stopper 140 may be integral with or secured very tightly to the support shaft 110. Alternatively, the housing 150 and the guide stopper 140 may be slidably combined with the support shaft 110.

The support 180 is at the other (e.g., upper) end of the support shaft 110. The support 180 receives pressure due to vibrations applied from the outside (e.g., the tub).

According to the exemplary embodiments, the suspension 100 may stably and/or sufficiently absorb vibrations regardless of the amount of laundry in the tub.

The operation principle of the suspension 110 for a washing machine according to embodiments of the present disclosure will be described hereafter.

In the suspension 100, the first elastic member 121 is relatively long and provides an elastic force while compressed first, and the second elastic member 122 provides an elastic force when compressed after the first elastic member 121 is compressed to a predetermined degree.

As a result, when low vibration pressure or compression is applied to the suspension 100, the first elastic member 121 having relatively low elasticity prevents micro-vibrations by absorbing low pressure vibrations, and when the vibration pressure applied to the suspension 100 increases, both the first elastic member 121 and the second elastic member 122 having relatively high elasticity absorb high-pressure vibrations, so that the effects of absorbing vibrations can be increased.

For example, with regard to the maximum vibration pressure or compression that is applied to the suspension 100, when the vibration pressure is less than 40% of the maximum vibration pressure, the first elastic member 121 absorbs the vibrations, and when vibration pressure is 40% or more of the maximum vibration pressure, both the first elastic member 121 and the second elastic member 122 can absorb the vibrations.

Such an example may be set by adjusting (i) the difference in the length between the first elastic member 121 and the second elastic member 122, (ii) the distance between the second elastic member 122 and the second locking portion 152 when the first elastic member 121 is not compressed, and (iii) the elastic forces of the first elastic member 121 and the second elastic member 122.

Figure 3:
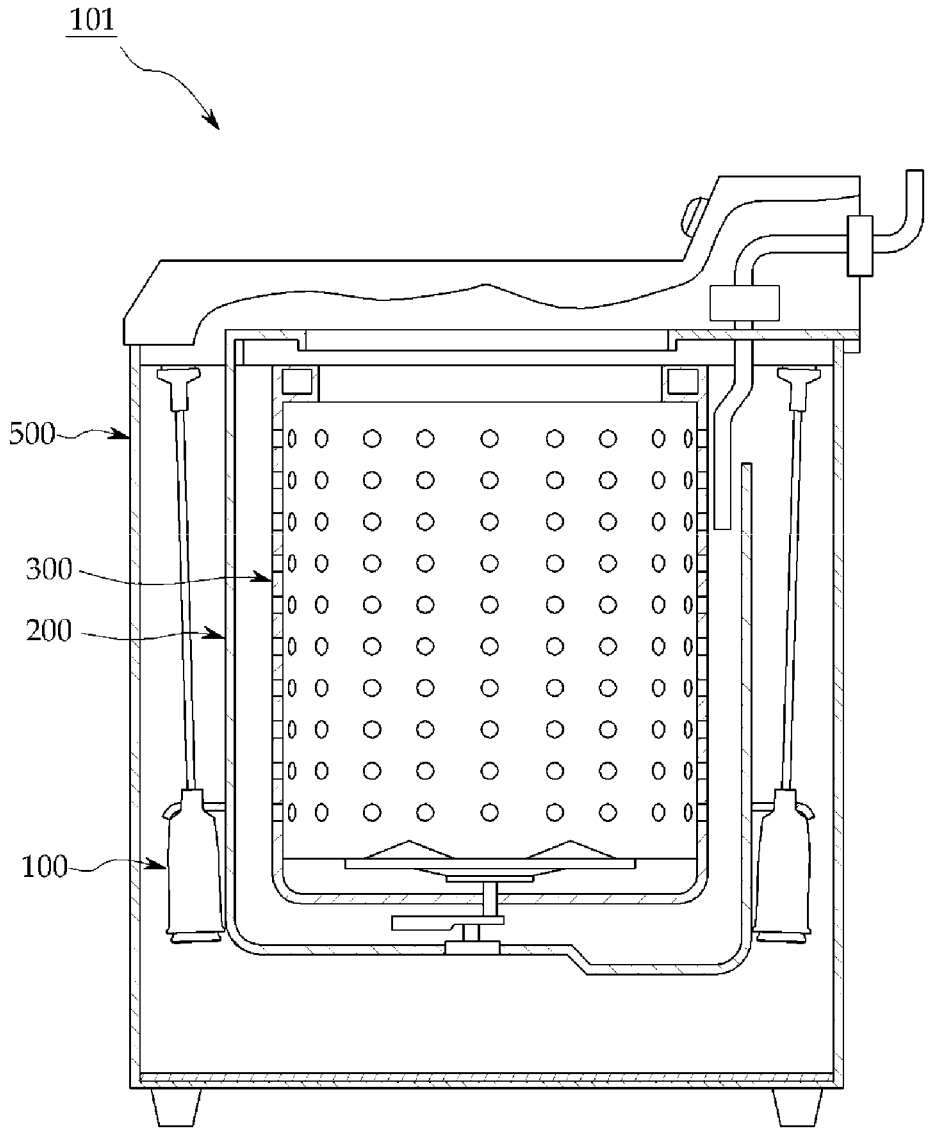
FIG. 3 is a cross-sectional view of an exemplary washing machine with the exemplary suspension according to embodiments of the present disclosure.

A washing machine 101 with the suspension 100 according to exemplary embodiments of the present disclosure will be described hereafter with reference to FIG. 3.

The washing machine 101 includes a water tank 200, a tub 300, a cabinet 500, and the suspension 100 as illustrated in FIG. 2.

The water tank 200 stores water and the rotatable tub 300 is in the water tank 200, configured to receive laundry. However, exemplary embodiments of the present disclosure are not limited thereto, and the water tank 200 and the tub 300 may be integral (e.g., formed as a single unit, and not assembled from two or more pieces).

The cabinet 500 houses the water tank 200 and forms the external shape of the washing machine 101. An operation panel (not illustrated) for operating the washing machine 101 may be on the cabinet 500.

The suspension 100 absorbs vibrations of the water tank 200, and has a first end or side connected to the water tank 200 and a second end or side connected to the cabinet 500.

In the suspension 100, the support 180 disposed at the other end of the support shaft 110 may be connected to the cabinet 500 and the housing 150 may be connected with the water tank 200.

However, exemplary embodiments of the present disclosure are not limited thereto, and in the suspension 100, the support 180 disposed at the upper end of the support shaft 110 may be connected to the water tank 200, and the housing 150 may be connected to the cabinet 500.

The detailed structure of the exemplary suspension 100 is the same as the exemplary suspension described above in relation to FIGS. 1 and 2.

Accordingly, the washing machine 101 with the suspension 100 according to exemplary embodiments of the present disclosure can effectively reduce vibrations, shock, and noise, regardless of the amounts of laundry.

The operation principle of the exemplary washing machine 101 with the exemplary suspension 110 will be described hereafter.

When the washing machine 101 washes a small amount of laundry, the first elastic member 121 having relatively low elasticity in the suspension 100 absorbs vibrations of the tub 300 and the water tank 200. The first elastic member 121 having a low elasticity is designed in consideration of a small laundry load due to its low elasticity, and the first elastic member 121 may prevent and/or absorb micro-vibrations that are generated when a small amount of laundry is washed.

When a large amount of laundry is washed, both the first elastic member 121 and the second elastic member 122 of the suspension 100 absorb vibrations of the tub 300 and the water tank 200. Since the second elastic member 122 having relatively high elasticity compensates any deficiency in the elastic force of the first elastic member 121 when a large load is washed, the washing machine 101 may effectively absorb vibrations that are generated from a large load of laundry.

With regards to the maximum weight of the water tank 200, when the weight of the water tank 200 is less than 40% of the maximum weight, the first elastic member 121 of the suspension 100 may absorb the vibrations alone, and when the weight of the water tank 200 is 40% or more of the maximum weight, both the first elastic member 121 and the second elastic member 122 of the suspension 100 may absorb the vibrations.

When the weight of the water tank 200 is less than 40% of the maximum weight, micro-vibrations may be generated due to the high elasticity of the second elastic member 122 an/or due to a small amount of laundry being washed. As a result, the first elastic member 121 absorbs the micro-vibrations alone.

When the weight of the water tank 200 is 40% or more of the maximum weight, the first elastic member 121 having relatively low elasticity may not sufficiently absorb the vibrations that are generated when a large amount of laundry is washed. Thus, the first and second elastic members 121 and 122 absorb the vibration when weight of tank 200 is 40% or more of weight maximum.

Such an example may be set by adjusting (i) the difference of length between the first elastic member 121 and the second elastic member 122, (ii) the distance between the second elastic member 122 and the second locking portion 152 when the first elastic member 121 is not compressed, and (iii) the elastic forces of the first elastic member 121 and the second elastic member 122.

Furthermore, vibrations from the washing machine may be further absorbed and/or minimized by utilizing one or more dampers on a bottom surface of the tank 200.

Therefore, the washing machine 101 with the suspension 100 according to exemplary embodiments of the present disclosure may effectively reduce vibrations, shock, and noise, regardless of the amount of laundry.

Although exemplary embodiments of the present disclosure are described above with reference to the accompanying drawings, those skilled in the art would understand that the present disclosure may be implemented in various ways without changing the necessary features or the spirit of the present disclosure.

Therefore, it should be understood that the exemplary embodiments described above are not limitative, but only an example in all respects, the scope of the present disclosure is expressed by claims described below, not the detailed description, and it should be construed that all of changes and modifications achieved from the meanings and scope of claims and equivalent concept are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A suspension for a washing machine, comprising:

a support shaft;

a first elastic member that surrounds a portion of the support shaft and provides a first elastic force to the support shaft in a longitudinal direction of the support shaft;

a second elastic member that is between the support shaft and the first elastic member, configured to provide a second elastic force different from the first elastic force, to the support shaft in a same direction as the first elastic member;

a guide stopper at a first end of the support shaft, configured to restrict movement of the first elastic member and the second elastic member in one direction; and a housing on the support shaft that surrounds the first elastic member and the second elastic member, configured to restrict movement of the first elastic member and the second elastic member in another direction, wherein the housing includes a first locking portion configured to restrict movement of the first elastic member in the a first direction and a second locking portion configured to restrict movement of the second elastic member in a second direction, wherein when the first elastic member is not compressed, the second elastic member is spaced apart from the second locking portion, wherein when pressure is applied longitudinally to the support shaft, the first elastic member is compressed first, and then the second elastic member is compressed, and the second elastic member is relatively more elastic than the first elastic member.

2. The suspension of claim 1, wherein the second elastic force is greater than the first elastic force.

3. The suspension of claim 1, wherein the first elastic member and the second elastic member each comprise a compression coil springs.

4. The suspension of claim 1, further comprising a support unit at a second end of the support shaft.

5. The suspension of claim 1, wherein the first elastic member is configured to absorb vibrations alone when a vibration pressure or compression is less than 40% of the maximum vibration pressure of a maximum vibration pressure or compression of the suspension, and both the first elastic member and the second elastic member are configured to absorb vibrations when the vibration pressure or compression is 40% or more of the maximum vibration pressure.

6. The suspension of claim 1, wherein an uncompressed length of the second elastic member is smaller than a maximum distance between the second locking portion of the housing and the guide stopper.

7. The suspension of claim 1, wherein the first elastic member has a first length and the second elastic member has a second length shorter than the first length.

8. The suspension of claim 7, wherein the first length is at least two times longer than the second length.

9. The suspension of claim 8, wherein the first length is at least three times longer than the second length.

10. A washing machine comprising:

a water tank configured to store water;

a rotatable tub in the water tank, configured to receive laundry;

a cabinet that houses the water tank; and a suspension that absorbs vibrations of the water tank, with a first end or side connected to the water tank and a second end or side connected to the cabinet, wherein the suspension comprises:

a support shaft;

a first elastic member that surrounds a portion of the support shaft and provides an elastic force to the support shaft in a longitudinal direction of the support shaft;

a second elastic member that is between the support shaft and the first elastic member, and configured to provide a second elastic force, different from the first elastic force to the support shaft in a same direction as the first elastic member;

a guide stopper that is at a first end of the support shaft, and configured to restrict movement of the first elastic member and the second elastic member in one direction; and a housing on the support shaft that surrounds the first elastic member and the second elastic member, and configured to restrict movement of the first elastic member and the second elastic member in another direction, wherein the housing includes a first locking portion configured to restrict movement of the first elastic member in a second direction and a second locking portion configured to restrict movement of the second elastic member in a second direction, wherein when the first elastic member is not compressed, the second elastic member is spaced apart from the second locking portion, wherein when pressure is applied longitudinally to the support shaft, the first elastic member is compressed first, and then the second elastic member is compressed, and the second elastic member is relatively more elastic than the first elastic member.

11. The washing machine of claim 10, wherein the first elastic member and the second elastic member each comprise a compression coil springs.

12. The washing machine of claim 10, wherein the suspension further comprises a support unit at a second end of the support shaft, and the support unit is connected with the cabinet and the housing is connected to the water tank.

13. The washing machine of claim 10, wherein the first elastic member absorbs vibrations alone when a weight of the water tank is less than 40% of the maximum weight of the water tank, and the first elastic member and the second elastic member both absorb vibrations when the weight of the water tank is 40% or more of the maximum weight.

14. The washing machine of claim 10, wherein the second elastic member has an uncompressed length that is smaller than the maximum distance between the second locking portion of the housing and the guide stopper.

* * * * *